US006378261B1

(12) United States Patent
Agsten

(10) Patent No.: US 6,378,261 B1
(45) Date of Patent: Apr. 30, 2002

(54) WALL SYSTEM INVOLVING PANELS

(76) Inventor: Carl F. Agsten, 1539 Bedford Rd., Charleston, WV (US) 25314

( * ) Notice: Subject to any disclaimer, the term of this patent is extended or adjusted under 35 U.S.C. 154(b) by 0 days.

(21) Appl. No.: 09/615,431

(22) Filed: Jul. 13, 2000

Related U.S. Application Data

(60) Provisional application No. 60/143,436, filed on Jul. 13, 1999.

(51) Int. Cl.[7] ..... E04B 2/54

(52) U.S. Cl. ..... 52/426; 52/783.19; 52/783.11; 52/425; 249/33; 249/190; 249/191

(58) Field of Search ..... 52/426, 425, 783.19, 52/783.11, 783.14, 428, 378, 587.1, 537, 581, 588.1, 582.562, 563, 569, 570; 249/38, 40, 44, 47, 190, 191, 192, 196, 213

(56) References Cited

U.S. PATENT DOCUMENTS

| | | | | | |
|---|---|---|---|---|---|
| 1,035,206 | A | * | 8/1912 | Lewen | 52/422 |
| 4,888,931 | A | * | 12/1989 | Meilleur | 52/426 |
| 5,040,344 | A | * | 8/1991 | Durand | 52/127.2 |
| 5,174,083 | A | * | 12/1992 | Mussell | 52/169.1 |
| 5,632,126 | A | | 5/1997 | Agsten | |
| 5,687,522 | A | * | 11/1997 | Durand et al. | 52/414 |
| 6,178,711 | B1 | * | 1/2001 | Laird et al. | 52/427 |

FOREIGN PATENT DOCUMENTS

| | | | |
|---|---|---|---|
| DE | 2255810 | * | 5/1974 |

* cited by examiner

*Primary Examiner*—Carl D. Friedman
*Assistant Examiner*—Jennifer I. Thissell
(74) *Attorney, Agent, or Firm*—Steptoe & Johnson PLLC

(57) ABSTRACT

A wall system is disclosed involving wall panels of corrugated sheets as a stay-in-place forming system for concrete for building a shelter for protection from severe weather conditions, e.g., tornadoes, hurricanes, etc. The corrugated sheets are joined together, both in adjacent and opposing positions, forming a crevasse between the corrugated sheets into which concrete is poured. Each corrugated sheet has a horizontal reinforcement member rigidly attached to the internal side of the corrugated sheet wherein a horizontal reinforcement member is an L-shaped angle steel having a plurality of connecting holes on its horizontal element. A plurality of uniting rods are used to connect two opposing wall panels by inserting each end of the uniting rod into the connecting holes of opposing horizontal reinforcement members. A connecting bar assembly is used to more securely connect two adjacent wall panels. The preferred connecting bar assembly is a connecting bar having a plurality of connecting holes that overlays the two horizontal reinforcement members of two adjacent wall panels such that the connecting holes of the connecting bar are aligned with the connecting holes of the horizontal reinforcement members, and two or more uniting rods and/or one or more connecting pins.

20 Claims, 3 Drawing Sheets

WALL SYSTEM INVOLVING PANELS

CROSS REFERENCE TO RELATED APPLICATIONS

This application claims the benefit of Application No. 60/143,436, filed in the U.S.P.T.O. on Jul. 13, 1999.

BACKGROUND OF INVENTION

1. Field of the Invention

This application relates to wall systems, and in particular to a wall system having stay-in-place corrugated panels joined together in adjacent and opposing configurations forming a hollow wall structure into which concrete is poured.

2. Related Art

Throughout every year the news is full of stories about severe weather conditions, e.g., tornadoes, hurricanes, and the like, and the resulting injuries and damage inflicted upon people and property. Therefore, there is a need for a wall system that can be used to build a temporary shelter for providing protection to one or more persons during life threatening, severe weather conditions. There is a need that such a wall system is easily built, requiring minimal effort and cost.

U.S. Pat. No. 5,632,126 ("the '126 Patent") provides a wall system having multiple panels that are configured into a sectional unit which may be filled with concrete to form the walls of a confinement cell. There are several reasons, however, as to why it would be disadvantageous to use the wall system of the '126 Patent in creating a shelter for the protection of persons from severe weather. First, the corrugated sheets have holes therein for fluid concrete to flow between the corrugated sheet and a face plate. A wall system of the '126 Patent is used to build confinement cells for inmates and other involuntary occupants. Accordingly, a face place is needed to prevent an occupant from accessing the internal structure of the wall panels, thereby eliminating the possibility of the occupant to escape or to store contraband within the wall panels. In contrast, occupants of the present invention are voluntary occupants that do not want to interfere with the integrity of the wall panels. Therefore, a face plate and concrete between the face plate and a corrugated sheet are unnecessary elements that would render a wall system for a weather shelter unduly complicated and expensive.

Second, two adjacent wall panels of the '126 Patent are connected solely by uniting rods. As the only means for joining two adjacent wall panels, the uniting rods provide a very unstable and non-rigid connection between sequential wall panels.

Therefore, there is a need for a wall system used for building a weather shelter having a sturdy and rigid means for connecting two adjacent wall panels, wherein each wall panel does not require superfluous elements such as a face plate and additional concrete between a corrugated sheet and a face plate.

SUMMARY OF INVENTION

The present invention solves the problems of conventional wall systems involving wall panels of corrugated sheets as a stay-in-place forming system for concrete. Specifically, the present wall system joins corrugated sheets together, both in adjacent and opposing configurations, thereby forming a crevasse between the corrugated sheets into which concrete is poured. Each corrugated sheet has a horizontal reinforcement member rigidly attached to the internal side of the corrugated sheet wherein a horizontal reinforcement member is an L-shaped angle steel having a plurality of connecting holes on its horizontal element. A plurality of uniting rods are used to connect two opposing wall panels by inserting each end of the uniting rod into the connecting holes of the horizontal reinforcement member of each opposing wall panel.

The present invention is directed to using the wall system for building a shelter for protection from severe weather conditions, e.g., tornadoes, hurricanes, etc. A person may build a shelter, e.g., an 8'×12' out-building, using the wall system of the present invention that upon the occurrence of such severe weather, one or more persons may enter the shelter and remain in the protective housing until the life-threatening weather passes.

There are several features of the present invention that provide a better and stronger wall system than conventional wall systems. First, the present wall system eliminates the need for any face plate from the interior wall surface. Conventional wall systems, e.g., in the '126 Patent, are used as confinement cells wherein a face plate is needed to prevent an involuntary occupant from attempting to access the internal wall structure as a means of escape or use the internal crevasse as a hiding place for weapons or contraband. In contrast, the present wall system provides a means for building protective housing to protect occupants from severe weather storms, e.g., tornados and hurricanes, wherein the occupants voluntarily want to stay in the protective housing. By eliminating the face plate, the present wall system is more cost effective and easier to assemble.

Second, the present wall system eliminates the holes in the corrugated sheet of conventional wall systems, e.g., in the '126 Patent, wherein the holes are used as a means for allowing concrete to flow into the space between a face plate and the corrugated sheet. Because the present invention does not require the use of a face plate, as discussed above, the wall system of the present invention does not require the use of holes in the corrugated sheet. In fact, the use of such holes would be detrimental to the present invention. If such holes existed in the corrugated sheet, then when concrete is poured into the crevasse of the wall system, the concrete would flow out of the crevasse between the corrugated sheets because there would be no face plate to contain the concrete, thereby preventing the wall from being filled up with concrete. Therefore, the need for the holes in the corrugated sheet is eliminated. Furthermore, the elimination of the holes in the corrugated sheet further reduces the price of manufacturing the components of the wall system and makes assembly easier.

Third, the present wall system comprises a more secure means for connecting adjacent wall panels. The preferred embodiment comprises a connecting bar being a piece of L-angled steel overlaid across a horizontal reinforcement member of a first wall panel and a horizontal reinforcement member of a second wall panel, thereby spanning the joint between the two adjacent wall panels. In the preferred embodiment, the L-angled steel is overlaid across four holes, two holes of the reinforcement member of the first wall panel and two holes of the reinforcement member of the second wall panel, so that the holes in the connecting bar are aligned with the holes of the reinforcement members to create a combination of aligned holes. A plurality of uniting rods are then inserted into the aligned holes as a means for securing the sequentially adjacent wall panels to each other as well as to opposing wall panels.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
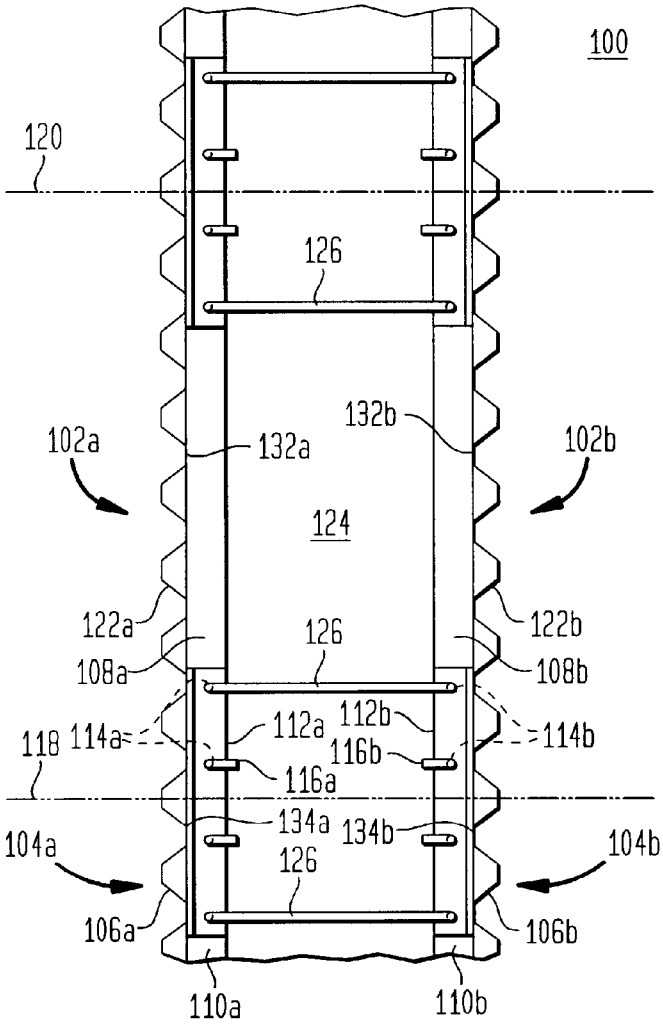
FIG. 1 is a planar top view of a wall system of the present invention.
Figure 2:
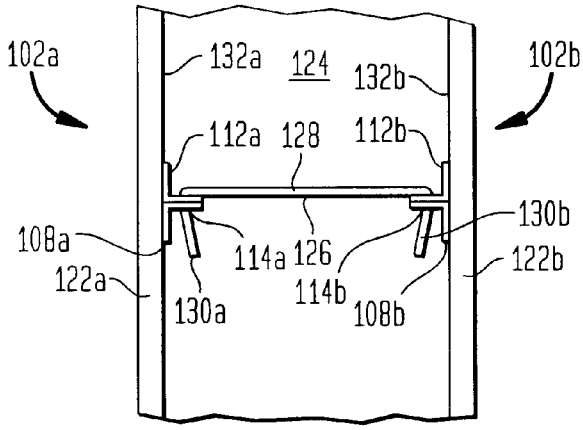
FIG. 2 is a planar side view of two interconnecting wall panels.
Figure 3:
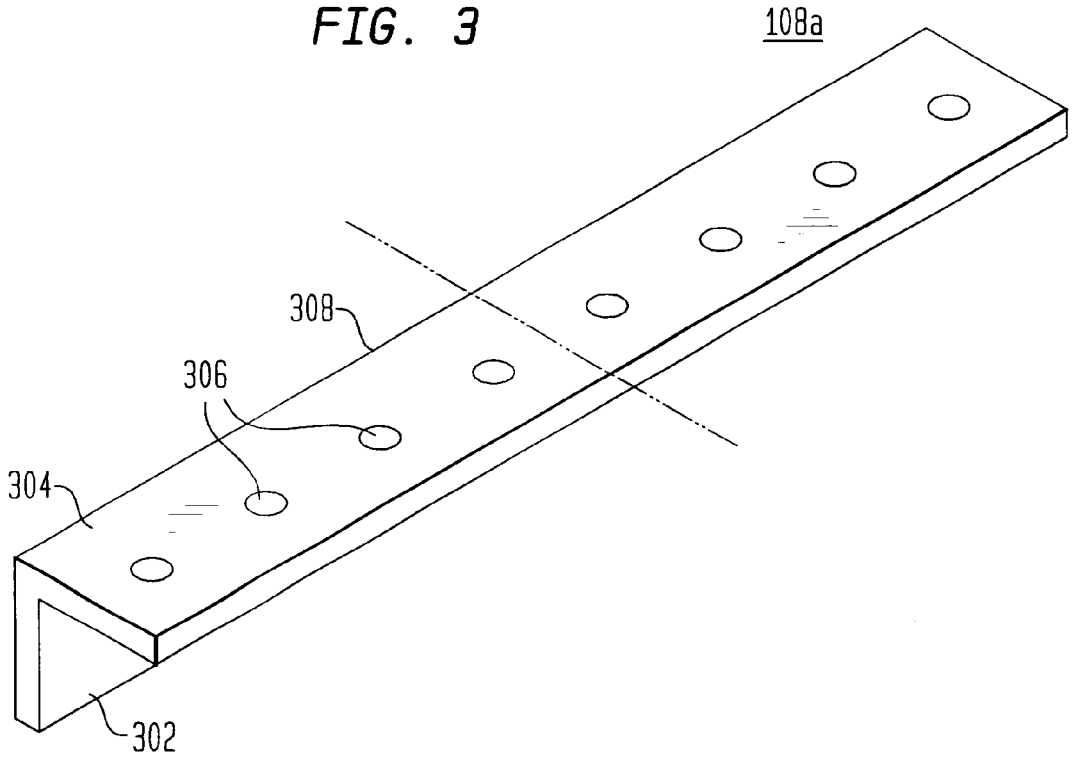
FIG. 3 is a perspective view of a horizontal reinforcement member.
Figure 4:
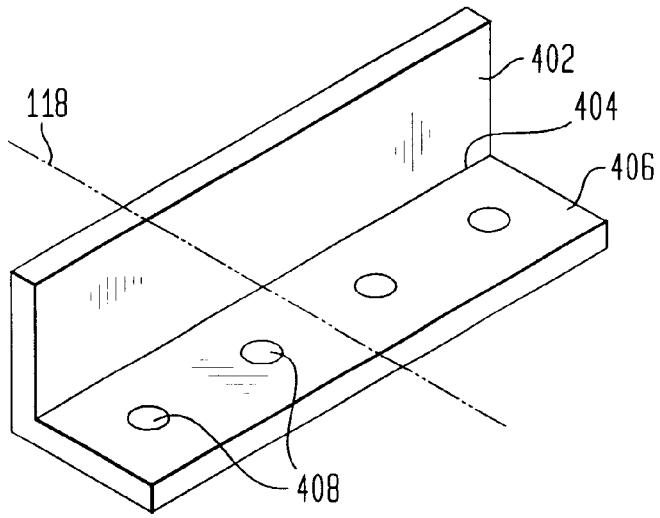
FIG. 4 is a perspective view of a connecting side bar.
Figure 5:
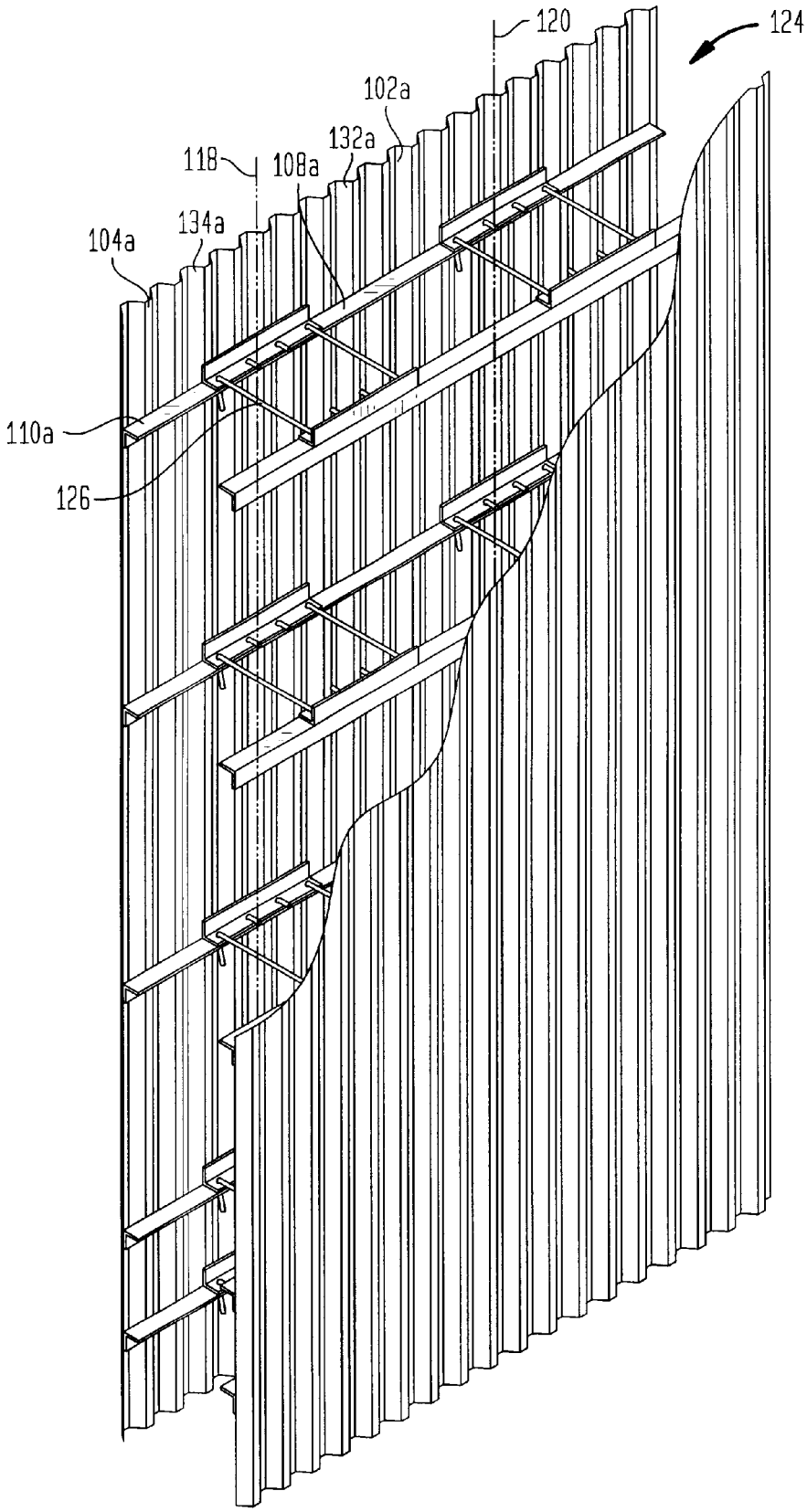
FIG. 5 is a perspective view of the wall system.

Referring now to the drawings in detail, the preferred embodiment of the wall system 100 of the present invention comprises multiple wall panels 102*a–b,* 104*a–b,* connected together both in adjacent and opposing configurations, thereby forming a crevasse 124, or interior space, into which concrete is poured. For convenience purpose only, the present invention is described in terms of four wall panels: a first wall panel 102*a,* a second wall panel 102*b,* a third wall panel 104*a* and a fourth wall panel 104*b.* It would be readily apparent to one of ordinary skill in the relevant art to design and build a wall system 100 of the present invention using any number of wall panels 102*a–b,* 104*a–b.*

As shown in FIG. 1, the first wall panel 102*a* is connected to the second wall panel 102*b* such that the first wall panel 102*a* is directly opposed, or across, from the second wall panel 102*b.* The third wall panel 104*a* is connected adjacent to the first wall panel 102*a;* and the fourth wall panel 104*b* is connected adjacent to the second wall panel 102*b,* wherein the third wall panel 104*a* is directly opposed from the fourth wall panel 104*b.*

In the preferred embodiment, each wall panel 102*a–b,* 104*a–b* comprises a corrugated sheet 122*a–b,* 106*a–b* having a horizontal reinforcement member 108*a–b,* 110*a–b* positioned on the internal side 132*a–b,* 134*a–b* of the corrugated sheet 122*a–b,* 106*a–b.* Each horizontal reinforcement member 108*a–b,* 110*a–b* is L-shaped angle steel having a vertical element 302 and a horizontal element 306 attached at a right angle, thereby forming an internal edge 308. A horizontal reinforcement member 108*a–b,* 110*a–b* is secured to the internal side 132*a–b,* 134*a–b* of a corrugated sheet 122*a–b,* 106*a–b* by welding, or otherwise rigidly attaching, e.g., nuts and bolts, the vertical element 302 of the horizontal reinforcement member 108*a–b* to the internal side 132*a–b,* 134*a–b* of the corrugated sheet 112*a–b* such that the horizontal element 304 is towards the top of the corrugated sheet 122*a–b,* 106*a–b.* In addition, the horizontal element 304 has a plurality of connecting holes 306 used to join a corrugated sheet 122*a,* 106*a* with a second corrugated sheet 122*b,* 106*b* directly opposed thereto. The connecting holes 306 are preferably about two inches apart, but this is for convenience purpose only. It would be readily apparent for one of ordinary skill in the relevant art to space the connecting holes 306 of a horizontal reinforcement member 108*a–b* by a different measurement.

In the preferred embodiment, the first wall panel 102*a* is connected to the opposing second wall panel 102*b,* and the third wall panel 104*a* is connected to the opposing fourth wall panel 104*b,* using uniting rods 126. A uniting rod 126 has a horizontal segment 128, a downwardly and inwardly extending first finger 130*a* at one end of the horizontal segment 128, and a downwardly and inwardly extending second finger 130*b* at the second end of the horizontal segment 128. In operation, the uniting rod 126 maintains the space between two opposing wall panels, e.g., between the first wall panel 102*a* and the second wall panel 102*b,* and between the third wall panel 104*a* and the fourth wall panel 104*b.* The shape and angle of the fingers 130*a–b* prevents opposing wall panels 102*a–b,* 104*a–b* from separating.

In the present invention, two sequentially adjacent wall panels, for example, the first wall panel 102*a* and the third wall panel 104*a,* are connected sequentially by using a connecting bar assembly for connecting the horizontal reinforcement member 108*a* of the first wall panel 102*a* with the horizontal reinforcement member 110*a* of the third wall panel 104*a.* In the preferred embodiment, these two horizontal reinforcement members 108*a,* 110*a* are connected via a connecting bar assembly comprising a connecting bar 112*a* which is a 7 inch long, 1"×1"×⅛" L-shaped piece of angle steel and one or more uniting rods 126 and/or one or more connecting pins. The connecting bar 112*a* is similar in structure to a horizontal reinforcement member 108*a–b,* 110*a–b* wherein the connecting bar 112*a* has a vertical element 402 and a horizontal element 406 attached at a ninety degree angle, thereby forming an internal edge 404. Furthermore, the horizontal element 406 of the connecting bar 112*a* has a plurality of connecting holes 408 that are spaced about two inches apart such that they align with the connecting holes 306 of a horizontal reinforcement member 108*a–b,* 110*a–b.*

In operation, a first connecting bar 112*a* is overlaid across the two horizontal reinforcement members 108*a,* 110*a* of two first adjacent wall panels 102*a,* 104*a,* thereby spanning the joint 118 between the first wall panel 102*a* and the third wall panel 104*a.* The first connecting bar 112*a* is configured such that the horizontal element 406 of the first connecting bar 112*a* overlays the horizontal element 304 of the two horizontal reinforcement members 108*a,* 110*a* and the vertical element 402 of the first connecting bar 112*a* is against the internal side 132*a–b,* 134*a–b* of the corrugated sheets 122*a,* 106*a.* In addition, the connecting holes 408 of the first connecting bar 112*a* are aligned with the connecting holes 306 of the two horizontal reinforcement members 108*a,* 110*a,* thereby creating aligned holes 114*a–b.* The vertical element 402 may optionally be secured to the internal side 132*a,* 134*a* of a corrugated sheets 122*a,* 106*a* by spot welding or by other comparable means, e.g., nuts and bolts.

Similarly, a second connecting bar 112*b* is overlaid across the two horizontal reinforcement members 108*b,* 110*b* of two second adjacent wall panels 102*b,* 104*b,* thereby spanning the joint 118 between the second wall panel 102*b* and fourth wall panel 104*b.* The above discussion regarding the configuration and operation of the first connecting bar 112*a* is equally applicable to the second connecting bar 112*b* used in connecting the second wall panel 102*b* and the fourth wall panel 104*b.*

In the preferred embodiment, the first connecting bar 112*a* comprises four connecting holes 408 such that two of the connecting holes 408 align with two of the connecting holes 306 in the horizontal member 304 of the first horizontal reinforcement member 108*a* and two of the connecting holes align 408 of the connecting bar 112*a* with two of the connecting holes 306 in the horizontal member 304 of the third horizontal reinforcement member 110*a,* thereby creating a plurality of first aligned holes 114*a.* The use of four holes in the first connecting bar 112*a* is for convenience purpose only. It would be readily apparent to one of ordinary skill in the relevant art(s) to use a different number of connecting holes 408. The second connecting bar 112*b* is used with the second horizontal reinforcement member 108*b* and the fourth horizontal reinforcement member 110*b* in the same manner as the first connecting bar 112*a,* thereby creating a plurality of second aligned holes 114*b*.

In the preferred embodiment, once aligned, one or more uniting rods 126 are used to connect the first horizontal reinforcement member 108*a* to the second horizontal reinforcement member 108*b* via the first and second aligned holes 114*a–b,* and the third horizontal reinforcement member 110*a* to the fourth horizontal reinforcement member 110*b* via their respective aligned holes. The first and second connecting bars 112*a–b* spanning the joint 118 provides the means of sequentially connecting the first wall panel 102*a* with the third wall panel 104*a* and the second wall panel 102*b* with the fourth wall panel 104*b*.

In addition, one or more connecting pins 116*a–b* can be used to secure a connecting bar 112*a–b* to a horizontal reinforcement rod 126 wherein the connecting pin 116*a–b* is a generally L-shaped pin that is bent slightly off from a ninety degree angle.

The connecting bars 112*a–b* are described as L-shaped angle for convenience purpose only. It would be readily apparent to one of ordinary skill in the relevant art(s) to use a different shaped bar, e.g., a flat elongated bar, that functions equivalently as the horizontal element 406 of the L-shaped angle embodiment of the connecting bars 112*a–b*. This alternative embodiment eliminates the use of a vertical element 402 of a connecting bar 112*a–b* and merely lays on top of the horizontal reinforcement members 108*a,* 110*a* of adjacent wall panels 102*a,* 104*a* wherein it is connected to opposing wall panels 102*b,* 104*b* in a similar manner described above.

A protective shelter can be built using the wall system 100 of the present invention by making four wall panels and arranging them in a square or rectangular shape, wherein the fourth wall panel has a door and a roof is built over the four wall panels. Once a shelter is built using wall panels, e.g., 102*a–b,* 104*a–b,* of the present invention, the crevasse 124, or space, between opposing wall panels, e.g., first wall panel 102*a* and third wall panel 102*b,* is filled with a filler material to make the shelter solid, permanent, and secure for protecting persons against severe weather conditions. In the preferred embodiment, the filler material may be concrete; however, this is for convenience purpose only. It would be readily apparent for one of ordinary skill in the relevant art to use a comparable material.

All dimensions and materials, e.g., corrugated sheet metal (steel, aluminum, etc.) and L-shaped angle (steel or iron), are used in the preferred embodiment and are for convenience purposes only. It would be readily apparent to one of ordinary skill in the relevant art to design and manufacture a wall system of the present invention using different dimension and to use comparable materials.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A wall system, comprising:

a first wall panel, comprising:

a first horizontal reinforcement member having one or more connecting holes, and a first sheet of a non-perforated material wherein said first horizontal reinforcement member is secured to the exterior of the internal side of said first sheet in a horizontal plane;

a second wall panel, comprising:

a second horizontal reinforcement member having one or more connecting holes, and a second sheet of a non-perforated material wherein said second horizontal reinforcement member is secured to the exterior of the internal side of said second sheet in a horizontal plane;

a first means for connecting said first wall panel and said second wall panel wherein said first wall panel is in a configuration opposing said second wall panel, thereby creating a crevasse between said first wall panel and said second wall panel; and a filler material filled within said crevasse.

2. The wall system according to claim 1, wherein said first means for connecting comprises one or more uniting rods.

3. The wall system according to claim 1, further comprising:

a third wall panel, comprising:

a third horizontal reinforcement member having one or more connecting holes, and a third sheet of a non-perforated material wherein said third horizontal reinforcement member is secured to the exterior of the internal side of said third sheet in a horizontal plane; and a second means for connecting sequentially said first wall panel and said third wall panel such that said first wall panel is adjacent to said third wall panel.

4. The wall system according to claim 3, wherein said second means for connecting is a connecting bar assembly having a connecting bar and a third means for connecting said connecting bar to said first horizontal reinforcement member and said third horizontal reinforcement member.

5. A wall system, comprising:

a first wall panel, comprising:

a first horizontal reinforcement member having one or more connecting holes, and a first sheet wherein said first horizontal reinforcement member is secured to the internal side of said first sheet in a horizontal plane;

a second wall panel, comprising:

a second horizontal reinforcement member having one or more connecting holes, and a second sheet wherein said second horizontal reinforcement member is secured to the internal side of said second sheet in a horizontal plane;

a first means for connecting said first wall panel and said second wall panel wherein said first wall panel is in a configuration opposing said second wall panel, thereby creating a crevasse between said first wall panel and said second wall panel;

a filler material filled within said crevasse;

a third wall panel, comprising:

a third horizontal reinforcement member having one or more connecting holes, and a third sheet wherein said third horizontal reinforcement member is secured to the internal side of said third sheet in a horizontal plane; and a second means for connecting sequentially said first wall panel and said third wall panel such that said first wall panel is adjacent to said third wall panel, wherein said second means for connecting is a connecting bar assembly having a connecting bar and a third means for connecting said connecting bar to said first horizontal reinforcement member and said third horizontal reinforcement member, wherein said connecting bar is an elongated flat bar having two or more connecting holes, wherein at least one connecting hole of said elongated bar is aligned with at least one connecting hole of said first horizontal reinforcement member of said first wall panel and at least one connecting hole of said elongated bar is aligned with at least one connecting hole of said third horizontal reinforcement member of said third wall panel.

6. The wall system according to claim 4, wherein said third means for connecting comprises one or more connecting pins.

7. The wall system according to claim 4, wherein said third means for connecting comprises one or more uniting rods.

8. A wall system, comprising:

a first wall panel, comprising:

a first horizontal reinforcement member having one or more connecting holes, and a first sheet wherein said first horizontal reinforcement member is secured to the internal side of said first sheet in a horizontal plane;

a second wall panel, comprising:

a second horizontal reinforcement member having one or more connecting holes, and a second sheet wherein said second horizontal reinforcement member is secured to the internal side of said second sheet in a horizontal plane;

a first means for connecting said first wall panel and said second wall panel wherein said first wall panel is in a configuration opposing said second wall panel, thereby creating a crevasse between said first wall panel and said second wall panel;

a filler material filled within said crevasse;

a third wall panel, comprising:

a third horizontal reinforcement member having one or more connecting holes, and a third sheet wherein said third horizontal reinforcement member is secured to the internal side of said third sheet in a horizontal plane; and a second means for connecting sequentially said first wall panel and said third wall panel such that said first wall panel is adjacent to said third wall panel, wherein said second means for connecting is a connecting bar assembly having a connecting bar and a third means for connecting said connecting bar to said first horizontal reinforcement member and said third horizontal reinforcement member, wherein said connecting bar is a piece of L-shaped angle having a vertical element, a horizontal element, and two or more connecting holes in said horizontal element, wherein said horizontal element of said piece of L-shaped angle overlays said first horizontal reinforcement member and said third horizontal reinforcement member such that at least one connecting hole in said horizontal element is aligned with one connecting hole of said first horizontal reinforcement member of said first wall panel and at least one connecting hole in said horizontal element is aligned with one connecting hole of said third horizontal reinforcement member of said third wall panel, and wherein said vertical element is in contact with the internal side of said first sheet of said first wall panel and with the internal side of said third sheet of said third wall panel.

9. The wall system according to claim 1, wherein said filler material is concrete.

10. The wall system according to claim 1, wherein said first sheet is a corrugated sheet of metal and said second sheet is a corrugated sheet of metal.

11. The wall system according to claim 1, wherein said first horizontal reinforcement member and said second horizontal reinforcement member are L-shaped angle steel.

12. A wall system, comprising:

a. a first wall panel, comprising:

a first horizontal reinforcement member having one or more connecting holes, and a first sheet of a non-perforated material wherein said first horizontal reinforcement member is secured to the internal side of said first sheet in a horizontal plane;

b. a second wall panel, comprising:

a second horizontal reinforcement member having one or more connecting holes, and a second sheet of a non-perforated material wherein said second horizontal reinforcement member is secured to the internal side of said second sheet in a horizontal plane; and c. a means for connecting sequentially said first panel and said second panel.

13. The wall system according to claim 12, wherein said means for connecting is a connecting bar assembly having a connecting bar and a second means for connecting said connecting bar to said first horizontal reinforcement member and said second horizontal reinforcement member.

14. A wall system, comprising:

a. a first wall panel, comprising:

a first horizontal reinforcement member having one or more connecting holes, and a first sheet wherein said first horizontal reinforcement member is secured to the internal side of said first sheet in a horizontal plane;

b. a second wall panel, comprising:

a second horizontal reinforcement member having one or more connecting holes, and a second sheet wherein said second horizontal reinforcement member is secured to the internal side of said second sheet in a horizontal plane; and c. a means for connecting sequentially said first panel and said second panel, wherein said means for connecting is a connecting bar assembly having a connecting bar and a second means for connecting said connecting bar to said first horizontal reinforcement member and said second horizontal reinforcement member, wherein said connecting bar is an elongated flat bar having two or more connecting holes, wherein at least one connecting hole of said elongated bar is aligned with at least one connecting hole of said first horizontal reinforcement member of said first wall panel and at least one connecting hole of said elongated bar is aligned with at least one connecting hole of said second horizontal reinforcement member of said second wall panel.

15. The wall system according to claim 13, wherein said second means for connecting comprises one or more connecting pins.

16. The wall system according to claim 13, wherein said second means for connecting comprises one or more uniting rods.

17. A wall system, comprising:

a. a first wall panel, comprising:

a first horizontal reinforcement member having one or more connecting holes, and a first sheet wherein said first horizontal reinforcement member is secured to the internal side of said first sheet in a horizontal plane;

b. a second wall panel, comprising:

a second horizontal reinforcement member having one or more connecting holes, and a second sheet wherein said second horizontal reinforcement member is secured to the internal side of said second sheet in a horizontal plane; and c. a means for connecting sequentially said first panel and said second panel, wherein said means for connecting is a connecting bar assembly having a connecting bar and a second means for connecting said connecting bar to said first horizontal reinforcement member and said second horizontal reinforcement member, wherein said connecting bar is a piece of L-shaped angle having a vertical element, a horizontal element, and two or more connecting holes in said horizontal element, wherein said horizontal element of said piece of L-shaped angle overlays said first horizontal reinforcement member and said second horizontal reinforcement member such that at least one connecting hole in said horizontal element is aligned with one connecting hole of said first horizontal reinforcement member of said first wall panel and at least one connecting hole in said horizontal element is aligned with one connecting hole of said second horizontal reinforcement member of said second wall panel, and wherein said vertical element is in contact with the internal side of said first sheet of said first wall panel and with the internal side of said second sheet of said second wall panel.

18. The wall system according to claim 12, wherein said first sheet is a corrugated sheet of metal and said second sheet is a corrugated sheet of metal.

19. A method for building a wall system, comprising the step of:

a. building a wall system as claimed in claim 1.

20. A method for building a protection shelter, comprising the steps of:

a. building a first wall system as claimed in claim 1;

b. building a second wall system as claimed in claim 1, wherein said second wall system is perpendicular to said first wall system and a first end of said second wall system is connected to a first end of said first wall system;

c. building a third wall system as claimed in claim 1, wherein said third wall system is perpendicular to said first wall system and opposed to said first wall system, and a first end of said third wall system is connected to a second end of said second wall system;

d. building a fourth wall system as claimed in claim 1, wherein said fourth wall system is perpendicular to said third wall system and a first end of said fourth wall system is connected to a second end of said third wall system, wherein said fourth wall system has a door; and e. building a roof connecting said first wall system, said second wall system, said third wall system, and said fourth wall system.

* * * * *